US007303661B2

(12) United States Patent
Katayama et al.

(10) Patent No.: US 7,303,661 B2
(45) Date of Patent: Dec. 4, 2007

(54) ELECTRODE FOR ELECTROLYSIS AND ION EXCHANGE MEMBRANE ELECTROLYTIC CELL

(75) Inventors: Shinji Katayama, Okayama (JP); Kiyohito Asaumi, Okayama (JP)

(73) Assignee: Chlorine Engineers Corp., Ltd., Tokyo (JP)

( * ) Notice: Subject to any disclaimer, the term of this patent is extended or adjusted under 35 U.S.C. 154(b) by 589 days.

(21) Appl. No.: 10/811,947

(22) Filed: Mar. 30, 2004

(65) Prior Publication Data

US 2004/0188245 A1 Sep. 30, 2004

(30) Foreign Application Priority Data

Mar. 31, 2003 (JP) ..... 2003-096401
Mar. 31, 2003 (JP) ..... 2003-096785

(51) Int. Cl.
*C25B 9/10* (2006.01)
*C25B 11/03* (2006.01)

(52) U.S. Cl. ..... 204/252; 204/278.5; 204/283

(58) Field of Classification Search ..... 204/252
See application file for complete search history.

(56) References Cited

U.S. PATENT DOCUMENTS 4,340,452 A * 7/1982 deNora ..... 205/525
5,599,430 A * 2/1997 Pimlott et al. ..... 204/252

FOREIGN PATENT DOCUMENTS

EP 1 464 728 A1 * 10/2004
JP 63-53272 B2 10/1988

* cited by examiner

*Primary Examiner*—Harry D Wilkins, III
(74) *Attorney, Agent, or Firm*—Sughrue Mion, PLLC

(57) ABSTRACT

A metal coil or an elastic cushion formed by winding the metal coil around a corrosion-resistant frame is sandwiched between an electrode and an electrode collector or a cell wall or is used as an electrode. The elasticity of the metal coil or the elastic cushion enables the easy handling and the uniform contact between the electrode and another electrolysis element. The metal coil or the elastic cushion can be also used as an elastic cathode. The elasticity of the elastic cathode also enables the easy handling of the electrode itself and the uniform contact between the ion exchange membrane and the current collector.

5 Claims, 4 Drawing Sheets

ELECTRODE FOR ELECTROLYSIS AND ION EXCHANGE MEMBRANE ELECTROLYTIC CELL

BACKGROUND OF THE INVENTION (a) Field of the Invention

The present invention relates to an electrode for electrolyzing an aqueous solution dissolving alkali metal chloride or any other electrolyte, and an ion exchange membrane electrolytic cell using a hydrogen generating cathode.

(b) Description of the Related Art

Electrolysis industry including chloroalkali electrolysis as its typical industry has an important role in material industry. In addition to this important role, energy-saving is earnestly required in a country where energy cost is high such as in Japan because the energy consumed in the chloroalkali electrolysis is higher.

The chloroalkali electrolysis has been converted from the mercury method into the ion exchange membrane method through the diaphragm method in order to solve the environmental problems and to achieve the energy-saving, and actually the energy-saving by about 40% has been attained in about 25 years. However, even the energy-saving to this extent is unsatisfactory, and as far as the current method is used, the further electric power saving is impossible while the cost of the energy or the electric power occupies about half of the total manufacture cost.

In an electrolytic cell mounting a hydrogen-generating cathode and used for brine electrolysis, cell voltage is reduced by disposing an anode, an ion exchange membrane and the hydrogen-generating cathode in intimate contact with one another. However, in a large-scaled electrolytic cell with an electrolytic area reaching to several square meters where an anode and a cathode are made of rigid materials, an inter-electrode distance can be hardly maintained at a specified value by intimately contacting both electrodes on an ion exchange membrane.

In order to reduce the interelectrode distance or a distance between the electrode and the corresponding electrode current collector or to maintain these at a nearly fixed value, an electrolytic cell using an elastic material therein is proposed.

The elastic material includes a non-rigid material such as a woven fabric, a non-woven fabric and a mesh, and a rigid material such as a blade spring.

The use of the non-rigid material arises such problems that the inter-electrode distance becomes non-uniform due to the partial deformation of the non-rigid material generated by the undue pressing from the counterelectrode side and the fine wires of the non-rigid material stick to an ion exchange membrane. The rigid material such as the blade spring inconveniently damages the ion exchange membrane, and reuse thereof may become impossible due to plastic deformation.

Various methods have been proposed for pressing the electrodes toward the ion exchange membrane in the ion exchange membrane electrolytic cell such as an electrolytic cell for brine electrolysis because the lowervoltage operation is desirable by intimately contacting the anode and the cathode with the ion exchange membrane.

As described, the structural characteristic of the electrolytic cell sandwiching the ion exchange membrane between the anode and the cathode is that, in order to prevent the damage of the ion exchange membrane by means of the uniform contact between the electrode and the ion exchange membrane and to maintain the inter-electrode distance to be minimum, at least one of the electrodes can freely move in a direction of the inter-electrode distance so that the electrode is pressed by an elastic element to adjust a holding pressure.

The elastic element includes a knitted fabric and a woven fabric made of metal wires or a structure prepared by stacking the fabrics, or by three-dimensionally knitting the fabrics or by three-dimensionally knitting the fabrics followed by crimp processing, and a non-woven fabric made of metal fibers, a coil hopper (spring) and a blade spring. These examples have spring elasticity of some kind.

On the other hand, the blade spring and the metal mesh are used for smoothly conducting the power supply from the current collector to the electrode in an industrial electrolytic cell such as that for brine electrolysis.

As described, however, the blade spring and the metal mesh are so rigid as to damage the ion exchange membrane and may not provide the sufficient electric connection due to its lower deformation rate.

In order to solve these problems, an electrolytic cell is disclosed in JP-B-63(1988)-53272 (FIGS. 1 to 8) in which a cathode is uniformly pressed toward a diaphragm to intimately contact the respective elements with one another by mounting a metal coil in place of the metal mesh between the cathode and the cathode end wall.

The extremely small diameter and the higher deformation rate of the metal coil sufficiently contact the respective elements with one another so that the stable operation of the electrolytic cell is possible.

SUMMARY OF THE INVENTION

An object of the present invention is to provide an electrolytic cell having a metal coil for securing electric connection between an electrode and an electrode current collector by removing the above-mentioned problems while by utilizing the above characteristics of the conventional metal coil.

The present invention provides, as a first aspect thereof, an ion exchange membrane electrolytic cell including an anode chamber accommodating an anode and an anode current collector, a cathode chamber accommodating a hydrogen-generating cathode and a cathode current collector, an ion exchange membrane dividing the electrolytic cell into the anode chamber and the cathode chamber, and a metal coil (or an elastic cushion formed by winding a metal coil around a corrosion-resistant frame) sandwiched between the anode and the anode current collector (or anode chamber wall) and/or between the hydrogen-generating cathode and the cathode current collector (or cathode chamber wall) (hereinafter referred to as "first invention").

In accordance with the first invention, the electrode and the current collector (or chamber wall) can be securely and electrically connected because the metal coil is freely deformed and has the sufficient conductivity. When the elastic cushion formed by winding the metal coil around the corrosion-resistant frame is used in place of the metal coil itself, it is easily handled, is hardly deformed and always keeps a specified amount of reaction force.

The present invention provides, as a second aspect thereof, an electrode for electrolysis which includes a metal coil supporting an electrode catalyst thereon or an elastic cushion supporting an electrode catalyst and formed by winding a metal coil around a corrosion-resistant frame or metal cotton supporting an electrode catalyst thereon (hereinafter referred to as "second inventions").

In accordance with the second invention, caustic soda or other electrolysis products can be generated with a higher efficiency without the mechanical damage of the ion exchange membrane and the insufficient current supply due to excessive deformation of the elastic electrode because the higher strength and the higher toughness of the electrode maintains the shape thereof for a longer period of time. Further, in the electrolytic cell accommodating the elastic electrode, the elastic electrode having the sufficient conductivity can be freely deformed so that the elastic electrode and the current collector can be electrically and securely connected with each other to enable the reliable current supply.

The above and other objects, features and advantages of the present invention will be more apparent from the following description.

PREFERRED EMBODIMENTS OF THE INVENTION

Figure 1:
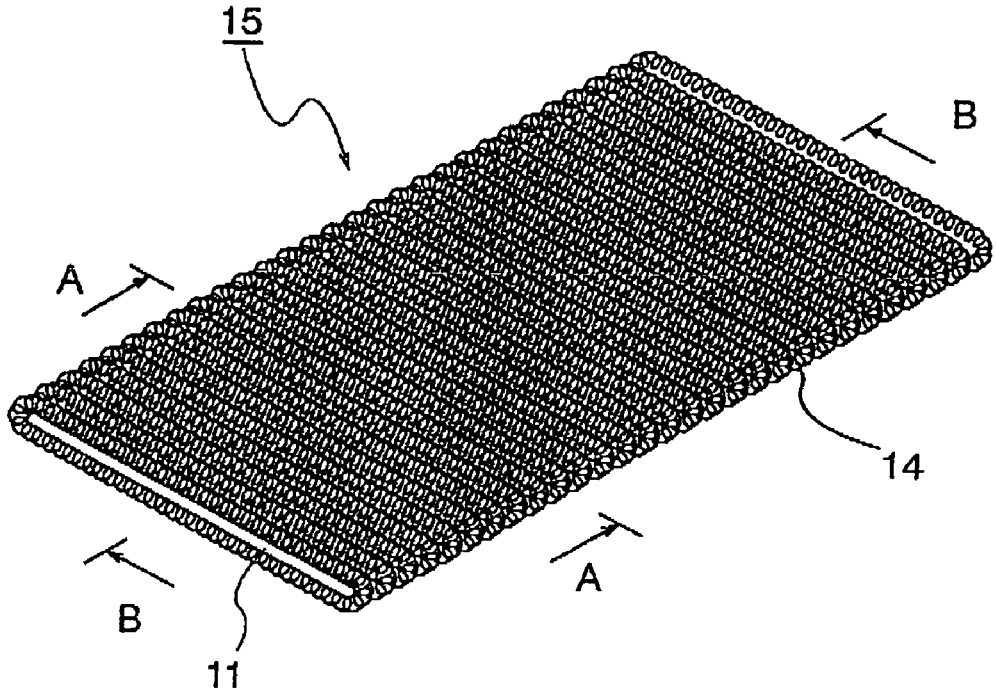
FIG. 1 is a perspective view showing an elastic cushion usable in the present invention.

In the first invention, the hydrogen-generating electrode is mounted in the ion exchange membrane electrolytic cell. The electrolysis reaction of the first invention is desirably that for producing alkali hydroxide (sodium hydroxide) by means of chloroalkali (brine) electrolysis.

The metal coil is positioned between the anode and the anode current collector or the anode chamber wall and/or between the hydrogen-generating cathode and the cathode current collector or the cathode chamber wall in the first invention.

In the second invention, on the other hand, the elastic electrode such as the meal coil, the elastic cushion and the metal cotton is used as at least one of the anode and the cathode in the ion exchange membrane electrolytic cell.

The electrode having the elasticity by itself does not necessitate the mounting of an elastic element other than the electrode in an electrolytic cell different from a conventional one. The electrode presses itself toward the ion exchange membrane as well as performs the functions of the electrode, thereby making the uniform and intimate contact between, for example, the ion exchange membrane and the current collector. When the metal coil, the elastic cushion and the metal cotton are, for example, locally pushed with a finger, the surface is concaved. When the finger is released from the surface, the surface is then restored to the original state. The metal coil, the elastic cushion and the metal cotton closely contact with respect to the convexo-concave of another element.

The electrolysis reaction of the second invention is desirably that for producing alkali hydroxide (sodium hydroxide) by means of chloroalkali (brine) electrolysis. However, it is not especially restricted provided that the above electrode can be used in the reaction.

The metal coil of the first invention or the second invention can be obtained by rolling wires such as nickel nickel alloy, stainless steel and copper which is prepared by plating a metal having a lower resistivity and an excellent corrosion resistance, to helical coils. The section of the wires is preferably a circle, an oval or a rectangle having rounded corners. A section having keen corners such as a triangle and a rectangle is not desirable for a purpose of preventing damage of the ion exchange membrane. For example, nickel wires [JIS (Japanese Industrial Standards) code: NW2201) having a diameter of 0.17 mm are rolled to provide coils having a rectangular shape of about 0.05 mm×0.5 mm with rounded corners and a winding diameter of about 6 mm. The coils thus obtained can be preferably used.

While the coils may be used as an anode or a cathode in an electrolytic cell or inserted between the subject electrode and the corresponding current collector or the chamber wall, the metal coil is desirably used as the elastic cushion after the metal coil is wound around the corrosion-resistant frame.

The metal coil having the higher deformation rate is difficult to be handled and difficult to be mounted at a specified position of the electrolytic cell in accordance with the intention of a worker. The easily deformed metal coil once mounted at the specified position may be subject to excursion by an electrolyte or a generated gas in the electrolytic cell so that the respective elements may be hardly in uniform contact with one another.

The elastic cushion can be obtained by, for example, winding one or more metal coils between two opposing rods among the four rods of the rectangular corrosion resistant frame at a nearly uniform mass per unit area. Although the two layers of the metal coils are ordinarily layered on the both sides of the corrosion resistant frame of the elastic cushion, the adjacent coils are engaged with each other in a comb-teeth fashion to provide one layer on its appearance. The elastic cushion thus obtained has an appearance of a metal scrubbing brush for washing food vessels.

The elastic cushion can be easily assembled out of the electrolytic cell and is mounted such that the subject electrode and the current collector (or chamber wall) are electrically connected or that the elastic cushion itself acts as the electrode. The elastic cushion itself is not deformed during the mounting because of the strength of the corrosion resistant frame and the assembly is not hindered. Accordingly, the elastic cushion is easily mounted on a specified position.

The diameter (apparent diameter) of the metal coil is shortened ordinarily by 10 to 70% to produce elasticity after the mounting in the electrolytic cell. The elasticity electrically and elastically connects the anode and the anode current collector (or anode chamber wall) or the cathode and the cathode current collector (cathode chamber wall), or enables the electrode itself to be held, for example, between the ion exchange membrane and the current collector, to facilitate the current supply to the electrode. The metal coil having the smaller apparent diameter necessarily increases the number of contact points between the electrode or the current collector and the elastic cushion to realize the uniform contact. The shape of the elastic cushion after the mounting in the electrolytic cell are held by the corrosion resistant frame so that the elastic cushion is scarcely subject to plastic deformation and can be used again after the re-assembly of the electrolytic cell.

When the ion exchange membrane electrolytic cell is assembled by using the elastic cushion between the specified elements in the first invention or by using the elastic cushion as the electrode in the second invention, the elastic cushion is positioned between at least one electrode and the current collector or the chamber wall or is positioned between the ion exchange membrane and the current collector, respectively, followed by the ordinary assembly, thereby providing the electrolytic cell having the elastic cushion sandwiched between the specified elements or held as the electrode.

In order to conduct the brine electrolysis by using the ion exchange membrane electrolytic cell having the above-described configuration, current is supplied between the electrodes while an electrolyte such as a brine is supplied to the anode chamber and a diluted caustic soda aqueous solution is supplied to the cathode chamber. In the electrolytic cell of the first invention, since the metal coil or the elastic cushion is held between the electrode and the current collector or the chamber wall, the ion exchange membrane or the other elements in the cell are not damaged and the current supply does not become insufficient because of the excessive deformation so that the caustic soda can be manufactured with a high efficiency. Also in the electrolytic cell of the second invention in which the metal coil or the elastic cushion acts as the electrode, since the high strength and the high toughness of the metal coil or the elastic cushion maintain the electrolysis conditions, the ion exchange membrane or the other elements in the cell are not mechanically damaged and the current supply does not become insufficient because of the is excessive deformation so that the caustic soda can be manufactured with a high efficiency.

Now, an embodiment of the present invention is more specifically described referring to the annexed drawings. However, the present invention is not restricted thereto.

Figure 2:
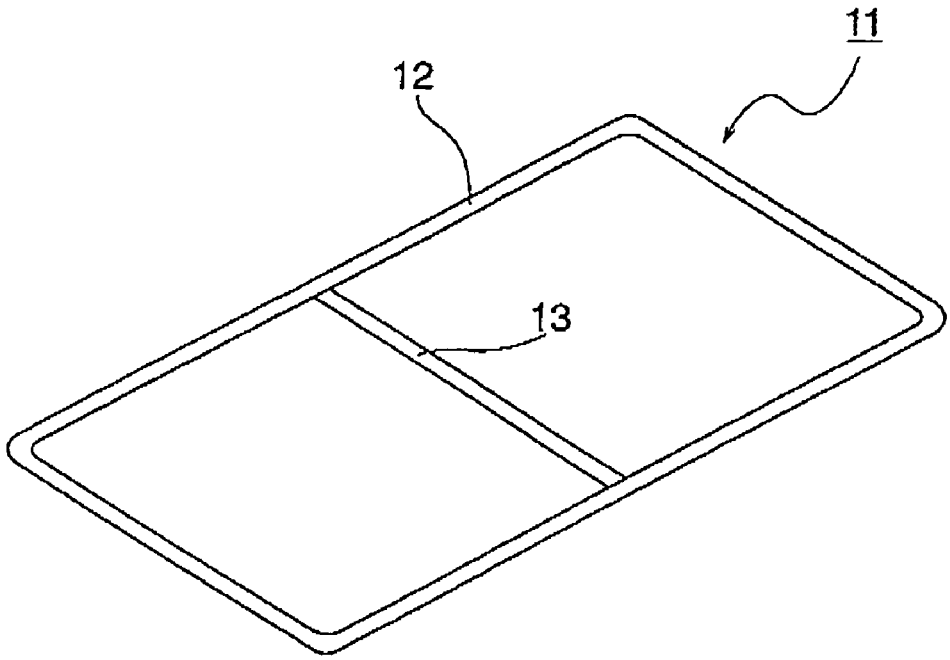
FIG. 2 is a perspective view showing a corrosion-resistant frame in the elastic cushion of FIG. 1.

As shown in FIGS. 1 and 2, a corrosion resistant frame 11 is composed of a rectangular frame 12 made of a metal rod such as a nickel rod, and an auxiliary rod 13 extending between a pair of the opposing round rods in the longitudinal direction.

Figure 3:
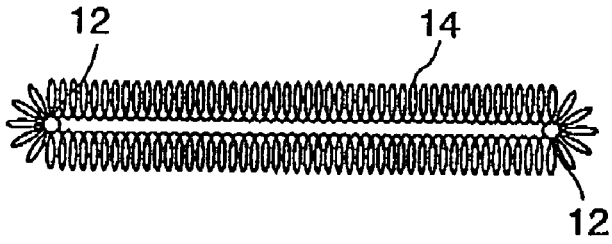
FIG. 3 is a vertical sectional view taken along a line A-A in FIG. 1.
Figure 4:
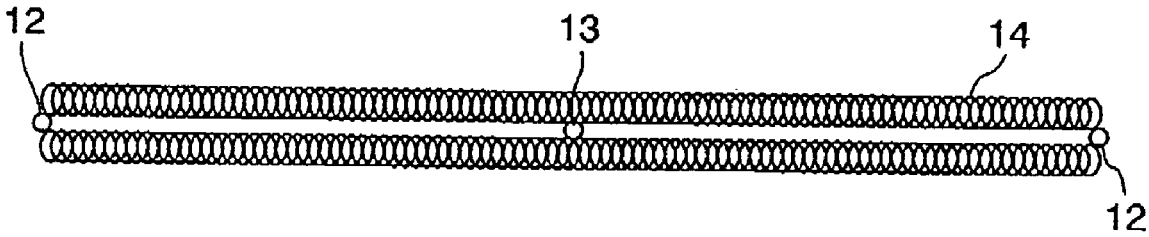
FIG. 4 is a vertical sectional view taken along a line B-B in FIG. 1.

A metal coil 14 shown in FIGS. 3 and 4 is obtained by rolling a metal wire with a small diameter into a coil. The metal coil 14 having an appearance of a metal scrubbing brush for washing is freely deformed without rigidity. As shown in FIG. 1, the metal coil 14 is wound between the pair of the round rods 12 in the longitudinal direction in their full lengths of the corrosion resistant frame 11 having a diameter of about 2 mm and made of nickel to fabricate an elastic cushion 15.

The elastic cushion 15 fabricated by winding the metal coil 14 around the corrosion resistant fame 11 maintains its shape as that of the corrosion resistant frame 11 so that the metal coil 14 is seldom separated from the corrosion resistant frame 11 and may be handled as integrated with the corrosion resistant frame 11.

Although the metal coil or the elastic cushion used for electrically connecting the electrode and another element such as a current collector and a chamber wall is not necessarily fixed to a cathode current collector and a cathode such as a hydrogen-generating cathode, it may be fixed. The current is ordinarily supplied by using a contact current supply system.

Figure 5:
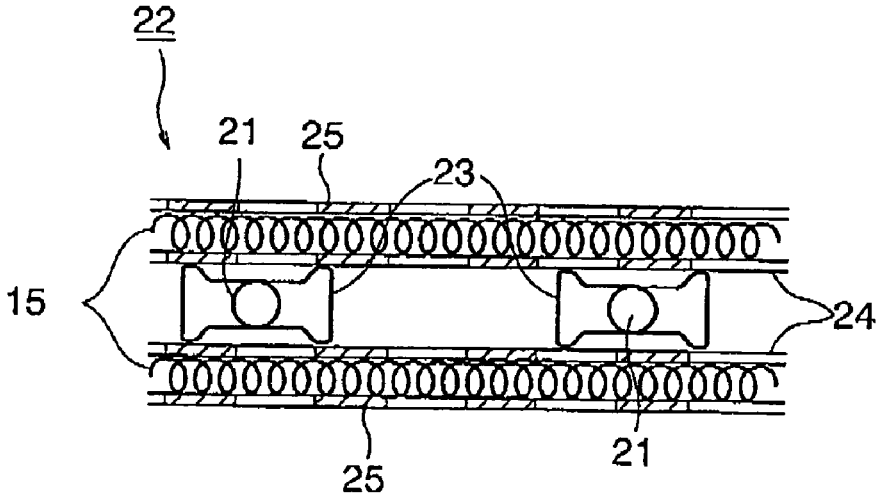
FIG. 5 is a schematic top plan view showing an example of the elastic cushion used for electric connection between a hydrogen-generating cathode and a cathode current collector in a monopolar electrolytic cell for brine electrolysis in accordance with the first invention.

As shown in FIG. 5, a pair of conducting rods 21 are positioned in a vertical direction in an electrolytic cell 22. A pair of catholyte circulation and current supply elements 23 are mounted around the conducting rods 21, and a pair of cathode current collectors 24 are positioned in parallel to the respective surfaces of the current supply elements 23 and are electrically connected thereto.

A pair of the elastic cushions 15 are then electrically connected to the cathode current collectors 24, and then a pair of hydrogen-generating cathodes 25 are in contact with the outer sections of the respective elastic cushions 15.

Figure 6:
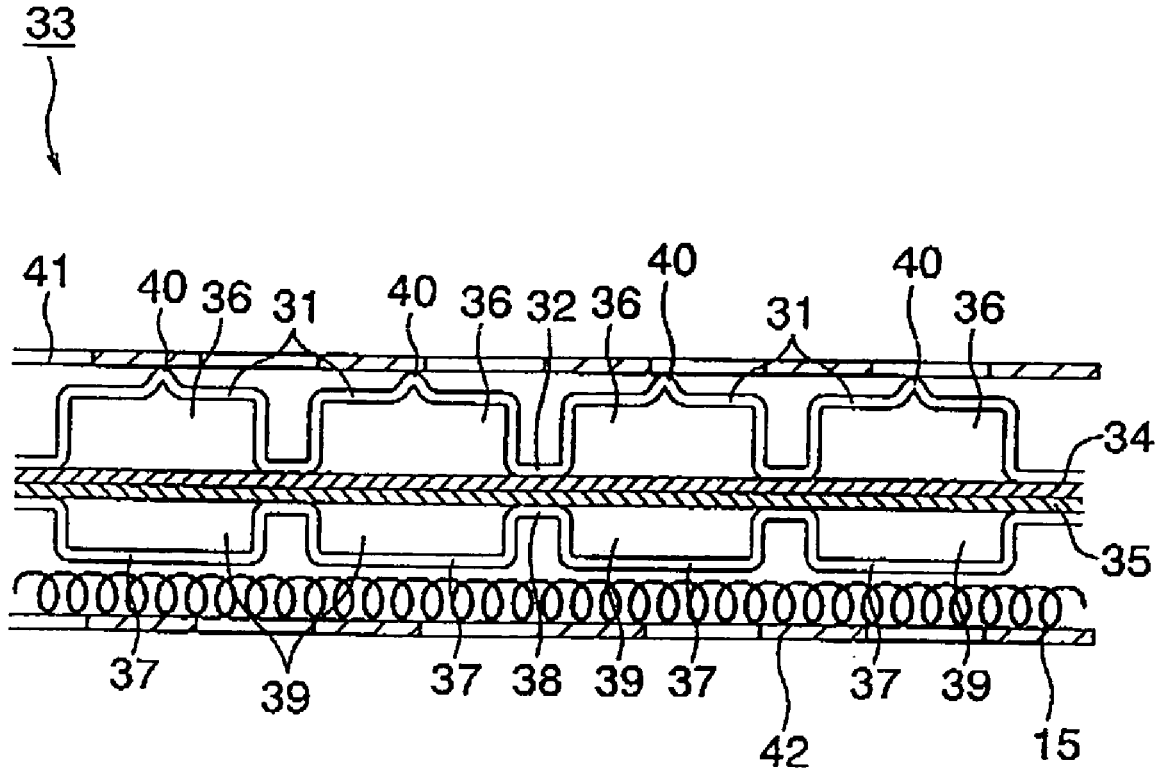
FIG. 6 is a schematic top plan view showing an example of the elastic cushion used for the electric connection between a hydrogen-generating cathode and a cathode current collector in a bipolar electrolytic cell for brine electrolysis in accordance with the first invention.

As shown in FIG. 6, integrated four anode holding elements 31 having strip-shaped bonding sections 32 and located in the vertical direction are fixed in an electrolytic cell 33 by bonding the strip-shaped bonding sections 32 to the anode side of an bonded wall having an anode partition wall 34 and a cathode partition wall 35. Anolyte circulation passages 36 are formed in the respective holding elements 31.

On the other hand, cathode holding elements 37 corresponding to the anode holding elements 31 are fixed to the cathode side of the bonded wall by bonding strip-shaped bonding sections 38 to the cathode partition wall 35, and catholyte circulation passages 39 are formed in the respective holding elements 37.

Projections 40 are formed at the center of the outer surfaces of the anode holding elements 31, and current is supplied through the projections 40 to an anode 41 having an expanded metal mesh.

The elastic cushion 15 or the metal coil 14 is in electric contact with the four flat surface of the cathode holding elements 37, and further a hydrogen-generating cathode 42 is in electric contact with the outer sections of the elastic cushion 15. Current is supplied from the cathode holding elements 37 to the hydrogen-generating cathode 42 through the elastic cushion 15.

When the elastic cushion 16 is used, it is easily handled and hardly deformed because the elastic cushion is formed by winding the metal coil around the corrosion-resistant frame.

Current is supplied between the electrodes while brine is supplied to the anode chamber and a diluted caustic soda aqueous solution is supplied to the cathode chamber in the above electrolytic cell to provide a concentrated caustic soda aqueous solution in the cathode chamber.

Figure 7:
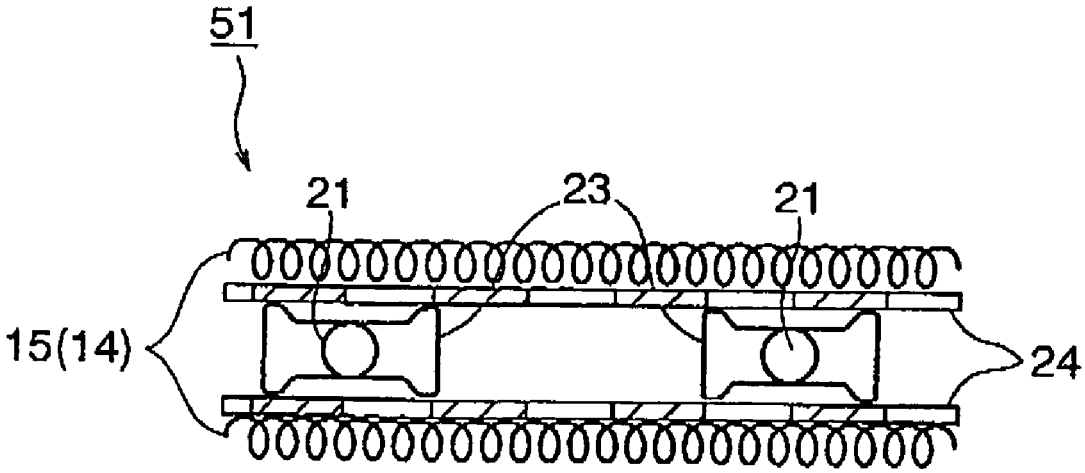
FIG. 7 is a schematic top plan view showing an example of a monopolar electrolytic cell for brine electrolysis using the elastic cushion as a cathode in accordance with the second invention.
Figure 8:
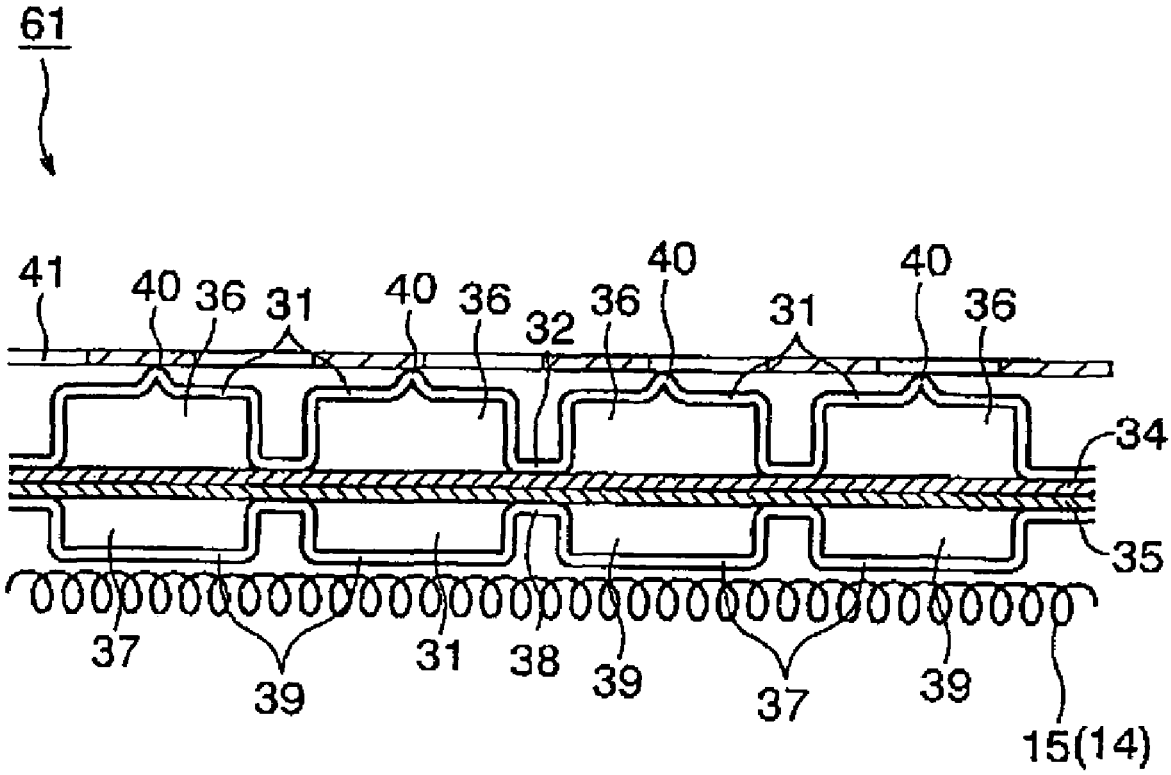
FIG. 8 is a schematic top plan view showing an example of a bipolar electrolytic cell for brine electrolysis using the elastic cushion as a cathode in accordance with the second invention.

Electrolytic cells 51 and 61 shown in FIGS. 7 and 8 are modifications of the electrolytic cell 22 shown in FIG. 5 and of the electrolytic cell 33 shown in FIG. 6, respectively, and the description of the same elements as those in FIGS. 5 and 6 will be omitted by denoting the same numerals thereto.

The electrolytic cell 51 in FIG. 7 has the same configuration as the electrolytic cell 22 in FIG. 5 except that the pair of the hydrogen-generating cathodes 25 are removed and the elastic cushion 15 or the metal coil 14 acts as an electrode.

The electrolytic cell 61 in FIG. 8 has the same configuration as the electrolytic cell 33 in FIG. 6 except that the hydrogen-generating cathode 42 is removed and the elastic cushion 15 or the metal coil 14 acts as an electrode.

Also in the electrolytic cells 51 and 61 shown in FIGS. 7 and 8, respectively, using the elastic cushion 15 as the cathode, the elastic cushion 15 is easily handled and hardly deformed.

Although Examples of the first invention and the second inventions will be described, the present invention shall not be deemed to be restricted thereto.

EXAMPLE 1

A unit ion exchange membrane electrolytic cell was assembled as follows.

A dimensionally stable electrode available from Permelec Electrode, Ltd. was used as an anode and an active electrode made of a nickel micromesh substrate was used as a cathode. The respective dimensions of the reaction surfaces of the anode and the cathode were 110 mm in width and 1400 mm in height. Flemion F-8934 available from Asahi Glass Co., Ltd. was used as an ion exchange membrane.

A nickel wire (JIS code: NW2201) having a diameter of 0.17 mm and a tensile strength of 620 to 680 N/m$^2$ was rolled to provide a metal coil having a width of about 0.5 mm and a winding diameter (apparent diameter) of about 6 mm.

The metal coil was wound around a frame formed by round rods made of nickel having a diameter of 2 mm (corrosion resistant frame) such that the shape thereof was adjusted in a rectangle to provide an elastic cushion having thickness of 10 mm, width of 110 mm and length of 350 mm. The metal coil mass per unit area of the elastic cushion was about 7 g/Idm$^2$. An expanded metal mesh made of nickel was used as a cathode. current collector.

The elastic cushion was inserted between the cathode current collector and the active cathode such that the elasticity was generated therebetween, and electrolysis was conducted for 30 days at a current density of 40 A/dm$^2$.

During the operation, electrolysis conditions were stable and caustic soda having high concentration was obtained.

EXAMPLE 2

A unit ion exchange membrane electrolytic cell was assembled as follows.

A dimensionally stable electrode having an effective area of 1540 cm$^2$ (11 cm in width and 140 cm in height) prepared by forming an electrode catalyst coating having a platinum-group metal oxide on an expanded metal made of titanium available from Permelec Electrode, Ltd. was used as an anode. The anode was mounted on an anode chamber wall of the electrolytic cell by using an anode rib.

A cathode current collector formed by expanded nickel was mounted on a cathode chamber wall by using a cathode rib formed by tabular nickel.

A nickel wire (JIS code: NW2201) having a diameter of 0.17 mm and a tensile strength of 620 to 680 N/m$^2$ was rolled to provide a metal coil having a width of about 0.5 mm and a winding diameter of about 6 mm.

The metal coil was wound around a frame formed by round rods made of nickel having a diameter of 2 mm (corrosion resistant frame) such that the shape thereof was adjusted in a rectangle to provide an elastic cushion having thickness of 10 mm, width of 110 mm and length of 350 mm. The metal coil mass per unit area of the elastic cushion was about 7 g/dm$^2$.

Then, an elastic cathode was prepared by plating the elastic cushion with platinum.

The surfaces of the respective metal coils constituting the elastic cushion and facing to the ion exchange membrane were plated with platinum by means of the brush plating (current: 0.5 A, time length of plating per 1 dm$^2$: 5 minutes) in which the elastic cushion was used as a plating cathode and a plastic brush having therein a titanium rod impregnated with a hexachloroplatinic acid solution (20 g/liter) was used as a plating anode.

The four platinum-supporting elastic cushions (The four elastic cathodes) were arranged on the cathode current collector.

A cation exchange membrane (Plemion F-8934 available from Asahi Glass Co., Ltd.) was disposed between the anode and the elastic cathode to assemble the electrolytic cell.

Electrolysis was conducted at a current density of 40 AJdm$^2$ and a temperature of 85° C. while brine with concentration of 310 g/liter was supplied to the anode chamber and a caustic soda aqueous solution was supplied to the cathode chamber so that the caustic soda aqueous solution with the concentration of 32% in weight was obtained in the cathode chamber. Cell voltage was 2.89 V.

EXAMPLE 3

An ion exchange membrane electrolytic cell was assembled as follows.

A dimensionally stable electrode having an effective area of 1540 cm$^2$ (11 cm in width and 140 cm in height) prepared by forming an electrode catalyst coating having a platinum-group metal oxide on an expanded metal made of titanium available from Permelec Electrode, Ltd. was used as an anode. The anode was mounted on an anode chamber wall of the electrolytic cell by using an anode rib.

A cathode current collector formed by an expanded metal was mounted on a cathode chamber wall by using a cathode rib formed by tabular nickel.

A woven fabric in a uniform cotton form was prepared by raveling nickel fibers having thickness of 5 mm, width of 11 cm and length of 20 cm with a fibers-raveling machine. The woven fabric was dipped at room temperature for one hour in a mixed solution including a hexachloroplatinic acid aqueous solution (20 g/liter) and hydrochloric acid (10 g/liter) to precipitate the platinum on the woven fabric, thereby providing a cathode.

Seven pieces of the cathodes (platinum-supported woven fabrics) were arranged on the cathode current collector, and a cation exchange membrane (Flemion F-8934 available from Asahi Glass Co., Ltd.) was disposed between the anode and the cathode to assemble the electrolytic cell.

Electrolysis was conducted at a current density of 40 A/dm$^2$ and a temperature of 85° C. while brine with concentration of 310 g/liter was supplied to the anode chamber and a caustic soda aqueous solution was supplied to the cathode chamber so that the caustic soda aqueous solution with the concentration of 32% in weight was obtained in the cathode chamber. Cell voltage was 2.87 V.

COMPARATIVE EXAMPLE 1

An anode was fabricated similarly to Example 3, and a cathode current collector was mounted similarly to Example 3.

Two metal meshes prepared by knitting eight nickel wires having a diameter of 0.08 mm in a stockinet manner were superposed and crimped to provide a mat (elastic current supplying element made of nickel) which was then disposed on the cathode current collector.

An active substance was coated on a metal mesh made of nickel having a diameter of 0.15 mm, a hole area rate of 68% and a hole area of 0.49 mm$^2$ in the following manner.

After the metal mesh was defatted by using steam, and etched in 15% nitric acid for one minute, paint with a composition having a hexachloroplatinic acid hexahydrate aqueous solution (20 g/liter), cesium nitrate hexahydrate aqueous solution (30 g/liter) and nitric acid (50 g/liter) was applied to the metal mesh and dried at 50° C. for five minutes. Then, the metal mesh was heated in a heating apparatus at 500° C. for 10 minutes and cooled to room temperature. The procedure (paint application-drying-decomposition) was repeated until the platinum concentration reached to 5 $gm^2$.

A nickel mesh was disposed as a cathode in contact with the nickel mat thus obtained, and a cation exchange membrane (Flemion F-8934 available from Asahi Glass Co., Ltd.) was disposed between the anode and the cathode to assemble the electrolytic cell.

Electrolysis was conducted at a current density of 40 $A/dm^2$ and a temperature of 85° C. while brine with concentration of 310 g/liter was supplied to the anode chamber and a caustic soda aqueous solution was supplied to the cathode chamber so that the caustic soda aqueous solution with the concentration of 32% in weight was obtained in the cathode chamber. Cell voltage was 2.90 V.

Comparison between Examples 2 and 3 and Comparative Example 1 reveals that the cell voltages of Examples 2 and 3 using the elastic cushion as the cathode were lower than that of Comparative Example 1 using the nickel mat and nickel mesh as the cathode so that more effective electrolysis could be conducted in the former.

Since the above embodiments are described only for examples, the present invention is not limited to the above embodiments and various modifications or alternations can be easily made therefrom by those skilled in the art without departing from the scope of the present invention.

What is claimed is:

1. An ion exchange membrane electrolytic cell comprising:

an anode chamber accommodating an anode;

a cathode chamber accommodating a hydrogen-generating cathode;

an ion exchange membrane dividing the electrolytic cell into the anode chamber and the cathode chamber; and an elastic cushion formed by winding a metal coil around a corrosion-resistant frame.

2. The ion exchange membrane electrolytic cell as claimed in claim 1, wherein:

the anode chamber further accommodates an anode current collector;

the cathode chamber further accommodates a cathode current collector; and the elastic cushion formed by winding the metal coil around the corrosion-resistant frame is sandwiched between the anode and the anode current collector and/or between the hydrogen-generating cathode and the cathode current collector.

3. An ion exchange membrane electrolytic cell as claimed in claim 1, wherein:

the anode chamber further accommodates an anode chamber wall;

the cathode chamber further accommodates a cathode chamber wall; and the elastic cushion formed by winding the metal coil around the corrosion-resistant frame is sandwiched between the anode and the anode chamber wall and/or between the hydrogen-generating cathode and the cathode chamber wall.

4. An ion exchange membrane electrolytic cell as claimed in claim 1, wherein:

at least one of the anode and cathode is an elastic electrode supporting an electrode catalyst.

5. The ion exchange membrane electrolytic cell as claimed in claim 4, further comprising an electrode current collector in contact with the elastic electrode for supplying current from the electrode current collector.

* * * * *